US008950487B2

(12) United States Patent
Baumann et al.

(10) Patent No.: US 8,950,487 B2
(45) Date of Patent: Feb. 10, 2015

(54) ASSEMBLIES AND METHODS FOR MINIMIZING PRESSURE-WAVE DAMAGE

(75) Inventors: Carlos Erik Baumann, Austin, TX (US); Harvey Williams, Houston, TX (US); Lawrence A. Behrmann, Houston, TX (US); Kenneth R. Goodman, Richmond, TX (US); Adil Al Busaidy, Kuala Lumpur (MY); Karim Al Sayed, Warszawa (PL); Fokko Harm Cornelis Doombosch, Oegstgeest (NL); Andrew J. Martin, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 371 days.

(21) Appl. No.: 13/312,082

(22) Filed: Dec. 6, 2011

(65) Prior Publication Data

US 2013/0140023 A1 Jun. 6, 2013

(51) Int. Cl.
*E21B 43/26* (2006.01)

(52) U.S. Cl.
USPC ..... 166/298; 166/55; 166/177.5

(58) Field of Classification Search
USPC ..... 166/297, 298, 55, 63, 177.5
See application file for complete search history.

(56) References Cited

U.S. PATENT DOCUMENTS

| | | | | |
|---|---|---|---|---|
| 4,372,384 | A * | 2/1983 | Kinney | 166/278 |
| 5,107,927 | A * | 4/1992 | Whiteley et al. | 166/50 |
| 5,174,379 | A * | 12/1992 | Whiteley et al. | 166/278 |
| 5,937,947 | A | 8/1999 | Holtby | |
| 6,793,017 | B2 * | 9/2004 | Nguyen et al. | 166/278 |
| 7,284,612 | B2 | 10/2007 | Ratanasirigulchai et al. | |
| 2011/0132608 | A1 | 6/2011 | Busaidy et al. | |

OTHER PUBLICATIONS

Johnson, Ashley B. and Walton I.C., "Perforating Shock and Jumping Processes", Mar. 12, 2001, 13 pages, PFD01-02; Perforating Research, Schlumberger Reservoir Completions, U.S.A.

Walton, Ian, "Shock Wave Impact on Perforating Guns", Oct. 1998, 10 pages, PFD98-12; Perforating Research, Schlumberger, U.S.A.

Carlos E. Baumann, Edison P. Bustillos, Juan P. Guerra, Awad William and Harvey A. Williams—SPE 143816—Reduction of Perforating Gunshock Loads, Society of Petroleum Engineers, presented at the Brazil Conference and Exhibition held in Macae, Brazil, Jun. 14-17, 2011, pp. 1-12.

Adil Al Busaidy, Zouhir Zaouali, Carlos Erik Baumann, Enzo Vegliante—SPE144080—Controlled Wellbore Implosions Show that Not All Damage is Bad—A New Technique to Increase Production from Damaged Wells, Society of Petroleum Engineers, presented at SPE European Formation Damage Conference held in Noordwijk, The Netherlands, Jun. 7-10, 2011, pp. 1-11.

(Continued)

*Primary Examiner* — William P Neuder
(74) *Attorney, Agent, or Firm* — Jeffery R. Peterson; Brandon S. Clark

(57) ABSTRACT

An assembly for minimizing damaging effects of pressure waves on devices in a wellbore. The assembly comprises a dynamic device disposed in the wellbore and generating pressure waves during actuation; a barrier device disposed in the wellbore and presenting an obstacle to the pressure waves generated by the dynamic device; and an occlusion disposed in the wellbore between the dynamic device and the barrier device which reduces the damaging effects of the pressure waves on the barrier device.

34 Claims, 6 Drawing Sheets

(56) References Cited

OTHER PUBLICATIONS

Carlos Baumann, Harvey Williams, Timothy Korf and Robert Pourciau—SPE146809—Perforating High-Pressure Deepwater Wells in the Gulf of Mexico, Society of Petroleum Engineers, presented at the SPE Annual Technical Conference and Exhibition held in Denver Colorado, U.S.A, Oct. 30-Nov. 2, 2011, pp. 1-12.

Carlos E. Baumann, Harbey A. R. Williams, Awad William and Vincent Pequignot—IBP3359-10—Prediction and Verification of TCP and Wireline Perforating Gunshock Loads, Brazilian Petroleum, Gas and Biofuels Institute—IBP—presented at the Rio Oil & Gas Expo and Conference 2010, held on Sep. 13-16, 2010 in Rio de Janeiro, pp. 1-10.

William Sanders, Carlos Baumann, Harvey Williams, Flavio Dias De Moraes, Jonathan Shipley, Martin Bethke and Scott Ogier—OTC21758—Efficient Perforation of High-Pressure Deepwater Wells, Offshore Technology Conference, presented at the Offshore Technology Conference held in Houston, Texas, USA, May 2-5, 2011, pp. 1-10.

* cited by examiner

ASSEMBLIES AND METHODS FOR MINIMIZING PRESSURE-WAVE DAMAGE

BACKGROUND

To complete a well, often one or more formation zones adjacent a wellbore are perforated to allow fluid from the formation zones to flow into the well for production to the surface or to allow injection fluids to be applied into the formation zones. A perforating gun may be lowered into the wellbore and fired to create openings in a casing and to extend perforation tunnels into the surrounding formation zones.

Pressure in the wellbore can also be manipulated in relation to the formation zones to achieve removal of debris from perforation tunnels or to achieve enhanced fluid flow from the formation zones. The pressure manipulation includes creating a transient underbalance condition (when the wellbore pressure is lower than the formation pore pressure) prior or subsequent to detonation of a detonation cord or shaped charges of limited energy. Pressure manipulation also includes creating a transient overbalance condition (when the wellbore pressure is higher than the formation pore pressure) prior or subsequent to detonation or explosion of shaped charges of a perforating gun or a propellant. Creation of an underbalance condition can be accomplished in a number of different ways, such as by use of a low pressure chamber that is opened to create the transient underbalance condition, use of empty space in a perforating gun or tube to draw pressure into the gun right after firing, and use of other techniques. The underbalance condition results in a suction force that extracts debris out of the perforation tunnels, allowing formation fluid to flow more efficiently into the wellbore or injection fluids to flow more efficiently into the formation zones. Creation of an overbalance condition can be accomplished by use of a propellant (which when detonated causes high pressure gas buildup), use of a pressurized chamber, or use of other techniques. The overbalance condition can cause pressure to increase to a sufficiently high level to fracture the formation zones. Fracturing allows for better communication of formation fluids into the wellbore or better injection of fluids into the formation zones.

Before perforation and before subsequent manipulation of wellbore pressure, one or more packers or plugs can be positioned between the inside of the wellbore and the outside of the perforating gun or underbalance or overbalance device to isolate the interval over which the detonation, explosion, or actuation takes place to achieve a quicker and amplified response for the perforation or for the underbalance or overbalance condition.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter. In some examples, the present disclosure provides assemblies for minimizing damaging effects of pressure waves in a wellbore. The assemblies can comprise a dynamic device disposed in the wellbore and generating pressure waves in the wellbore. A barrier device disposed in the wellbore presents an obstacle to the pressure waves generated by the dynamic device. An occlusion disposed in the wellbore between the dynamic device and the barrier device reduces damaging effects of the pressure waves on the barrier device. In other examples, the present disclosure provides methods for minimizing damaging effects of pressure waves in a wellbore. The methods can comprise disposing an occlusion in the wellbore between a dynamic device and a barrier device, which presents an obstacle to the pressure waves generated by the dynamic device. The dynamic device is actuated and generates pressure waves. The occlusion absorbs and reduces damaging effects of the pressure waves on the barrier device.

BRIEF DESCRIPTION OF THE DRAWINGS

Embodiments of assemblies and methods for minimizing pressure-wave damage are described with reference to the following figures. The same numbers are used throughout the figures to reference like features and components.

DETAILED DESCRIPTION

In the following description, certain terms have been used for brevity, clearness and understanding. No unnecessary limitations are to be inferred therefrom beyond the requirement of the prior art because such terms are used for descriptive purposes and are intended to be broadly construed. The different assemblies and methods described herein may be used alone or in conjunction with other assemblies and methods. It is to be expected that various equivalents, alternatives, and modifications are possible within the scope of the appended claims.

As used here, the terms "up" and "down"; "upper" and "lower"; "uppermost" and "lowermost"; "uphole" and "downhole"; "above" and "below" and other like terms indicating relative positions above or below a given point or element are used in this description to more clearly describe some embodiments of the disclosure. However, when applied to assemblies and methods for use in wells that are deviated or horizontal, such terms may refer to left to right, right to left, or other relationships as appropriate.

Figure 1:
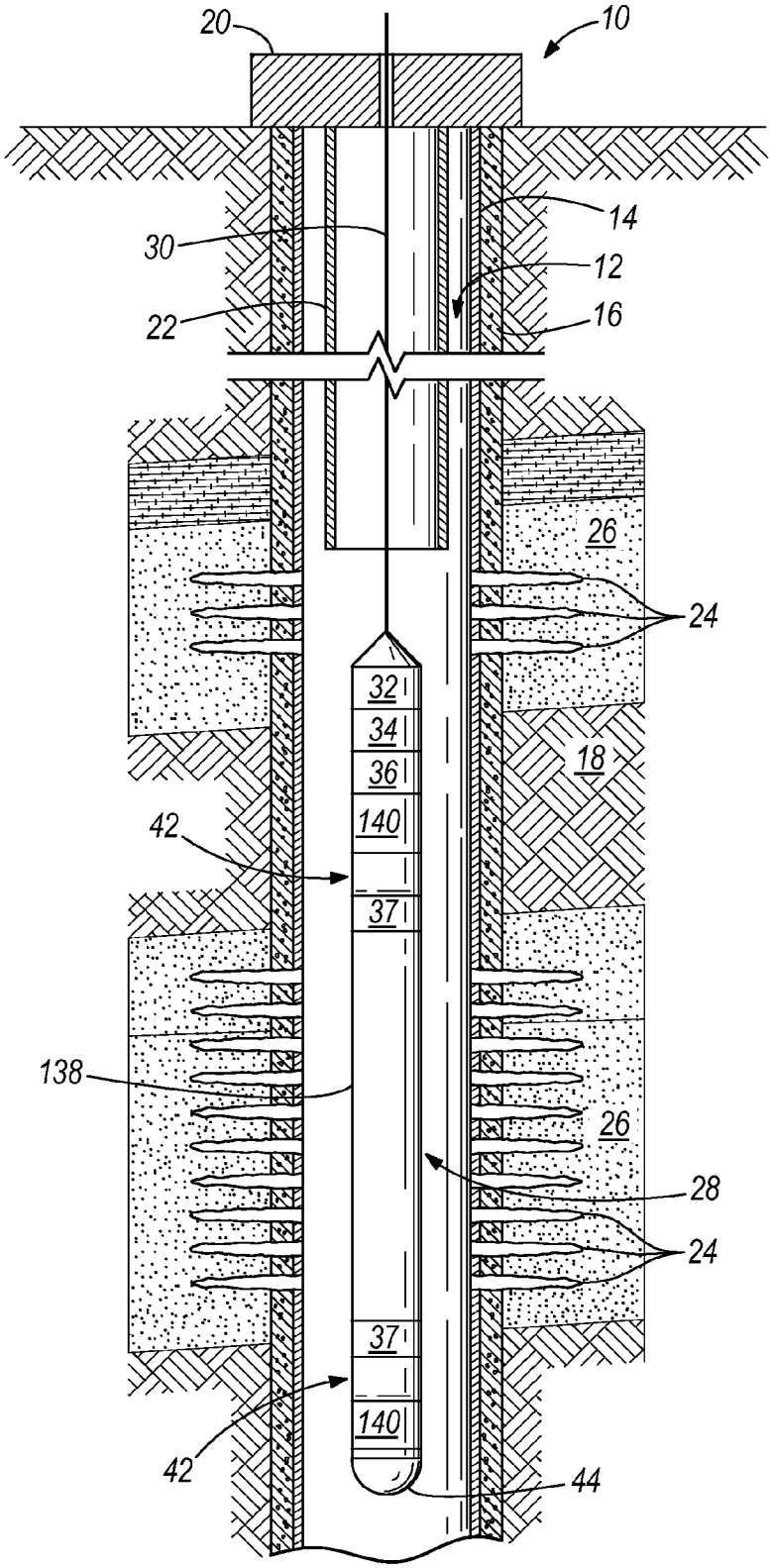
FIG. 1 is a schematic of a tool string disposed within a wellbore.

FIG. 1 illustrates a typical well installation 10 including a wellbore 12. Wellbore 12 has a surrounding casing 14 and cement 16 disposed between the casing 14 and a surrounding subsurface formation 18. A well head 20 can be positioned at the top of the formation 18 and provided with tubing 22 that extends downwardly into an upper portion of the wellbore 12. Perforation tunnels 24 extend transversely through the casing 14 and cement 16 into the formation 18 at one or more formation zones 26 from which extraction of formation fluids is desired.

A tool string 28 is suspended by a carrier mechanism 30 that extends through the tubing 22. The carrier mechanism 30 can be a wireline, slickline, e-line, drillpipe, coiled tubing, and/or the like. The lower end of carrier mechanism 30 is secured to a head 32 which, in turn, can be connected to a casing collar locator 34, which confirms and/or correlates the depth of the tool string 28, and/or a firing head 36, which initiates detonation of shaped charges (not shown). Also disposed on the tool string 28 is a dynamic device 138 as well as one or more barrier devices 140, of which the structure and function will be described herein below. The tool string 28 further comprises connectors 37, which can be threaded or non-threaded unions or joints that connect components of the tool string 28, and a threaded end plug 44, which secures components on the tool string 28.

The dynamic device 138 is any type of device that can be actuated to achieve varying results, including but not limited to: (1) perforation of the surrounding casing 14 and cement 16; (2) creation of a dynamic underbalance condition within the wellbore 12; and/or (3) creation of a dynamic overbalance condition within the wellbore 12. Creating and controlling dynamic underbalance and overbalance conditions within a wellbore are further described in U.S. Pat. No. 7,284,612 and U.S. Patent Publication No. 2011/0132608, the disclosures of which are incorporated by reference herein in their entirety.

Perforation is accomplished by lowering the dynamic device 138, in this case a perforating gun, through the wellbore 12 on the carrier mechanism 30 until it is positioned adjacent a formation zone 26. Shaped charges on the perforating gun are then ignited and generate sufficient force to penetrate the casing 14 and cement 16 and into the formation zone 26, resulting in perforation tunnels 24. Other types of dynamic devices 138 can be employed to achieve perforation, such as for example those that employ lasers, jets of abrasive fluid, bullets, and/or the like.

Creation of a dynamic underbalance condition can be accomplished in at least two ways: during perforation and/or with a dynamic underbalance device. A dynamic underbalance condition results during perforation if the pressure inside the perforating gun is lower than that within the wellbore 12, as wellbore fluids are drawn into the perforating gun to counteract such a pressure differential. Creation of a dynamic underbalance condition can also be accomplished with a dynamic device 138 such as a dynamic underbalance device, for example a hollow tube containing a low pressure gas, or a perforating gun that produces a pressure inside the carrier lower than the wellbore pressure. Other types of dynamic devices 138 can be used to create dynamic underbalance conditions.

Creation of a dynamic overbalance condition can be accomplished in at least two ways: during perforation and/or with a dynamic overbalance device. A dynamic overbalance condition results during perforation if the pressure inside the perforating gun is higher than that within the wellbore 12, as pressure from the perforating gun expands and fractures the formation zones 26. Creation of a dynamic overbalance condition can also be accomplished with a dynamic device 138 such as a dynamic overbalance device, for example a hollow tube containing a high pressure gas, a liquefied gas that vaporizes according to a change in pressure or temperature inside the wellbore 12, or a flammable propellant. Other types of dynamic devices 138 can be used to create dynamic overbalance conditions.

Actuation of the dynamic devices 138, such as by ignition of shaped charges during perforation and/or actuation of a dynamic underbalance or overbalance device, causes pressure differentials within the wellbore 12. This creates pressure waves that travel along the wellbore 12 and hit devices in the wellbore 12, such as devices on the tool string 28, including but not limited to packers or plugs. When the pressure waves hit such "barrier devices" 140, they produce large loads. Large loads can have a destructive effect on the tool string 28 because the actual forces on the tool string 28 can be much larger than the applied load of the pressure waves if the fundamental frequency of the tool string 28 is close to the leading frequency of the applied load produced by the pressure waves. The present inventors have found that such loads can be minimized by reducing the magnitude of the pressure waves and by extending the time it takes for the load to change direction. As explained further herein below, the present inventors have found that one or more occlusions 42, examples of which are described herein below, can be used to minimize such damaging effects on the tool string 28. Further, dynamic underbalance or overbalance conditions can be confined to localized areas of the wellbore 12 between such occlusions 42, which absorb and/or reflect the pressure waves.

In the following examples, for ease of description, the dynamic device 138 referred to will be a perforating gun 38 and the barrier device 140 referred to will be a packer 40. However, other dynamic devices 138 (such as for example the tubular dynamic underbalance or overbalance devices described above, and/or the like) and other barrier devices 140 (such as for example plugs and/or the like) could be provided on the tool string 28.

Figure 2:
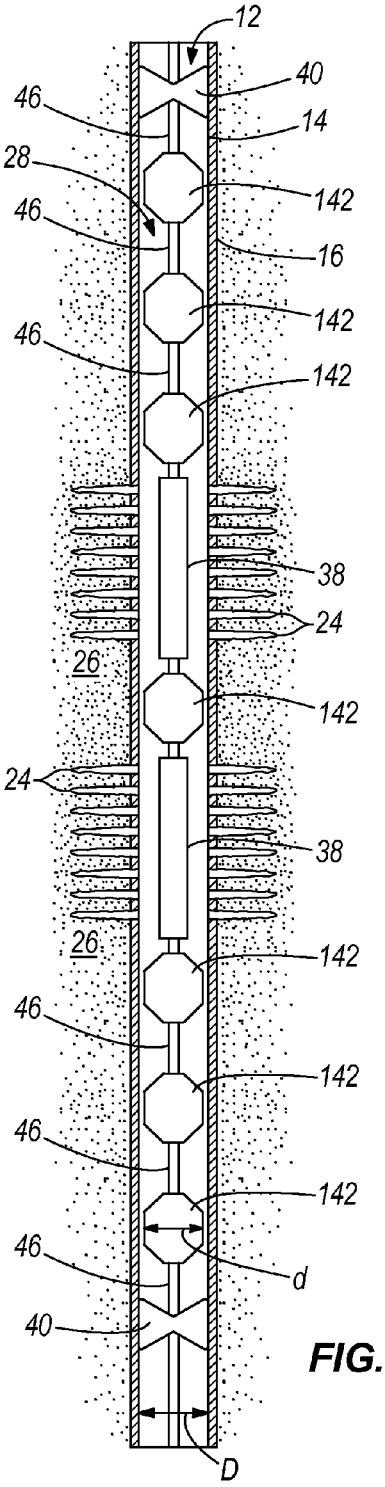
FIG. 2 is a schematic of a tool string and a plurality of solid occlusions such as solid centralizers.

FIG. 2 illustrates one example of the assembly, wherein one or more perforating guns 38, one or more packers 40, and a plurality of pup joints 46 are disposed on the tool string 28. In this example the occlusions 42 are solid occlusions, such as solid centralizers 142, that center the tool string 28 in the wellbore 12. Centering occurs according to the following: The wellbore 12 has an inner diameter D and the solid centralizers 142 have an outer diameter d that is smaller than the inner diameter D of the wellbore 12. The solid centralizers 142 fit around the tool string 28 due to a central bore 48 (see FIGS. 3 and 4). The outer diameter d of the solid centralizers 142 is located close to the inner diameter D of the wellbore 12 so as to center the tool string 28 in the wellbore 12.

In the example shown, one solid centralizer 142 is placed between any two perforating guns 38, a plurality of solid centralizers 142 are placed both above and below the perforating guns 38, and a pup joint 46 is positioned between each of the solid centralizers 142 within the plurality. However, other configurations are possible. In this example, a first plurality of solid centralizers 142 are located uphole of the uppermost perforating gun 38 and a second plurality of solid centralizers 142 are located downhole of the lowermost perforating gun 38. The first plurality of solid centralizers 142 is equal in number to the second plurality of solid centralizers 142; in this example, three solid centralizers 142 are used both above and below the perforating guns 38. Placing approximately the same number of solid centralizers 142 both above and below the perforating guns 38 ensures that the pressure loss the solid centralizers 142 generate does not produce an uncompensated load that is transmitted along the tool string 28 that would otherwise be absorbed by the packers 40. Together, the solid centralizers 142 located uphole of the perforating guns 38 and the solid centralizers 142 located downhole of the perforating guns 38 absorb and reflect the pressure waves generated by the perforating guns 38 to minimize damaging effects on the packers 40.

Besides minimizing damaging effects on the packers 40, this arrangement also maintains or improves dynamic underbalance and overbalance conditions in localized areas around the perforating guns 38, because the solid centralizers 142 prevent wellbore fluid from freely flowing through the wellbore 12 in areas that are not targeted for such a dynamic underbalance or overbalance condition. This prevention of freely flowing fluid occurs because the outer diameter d of the solid centralizers 142 is close to the drift diameter of the wellbore 12.

Figure 3:
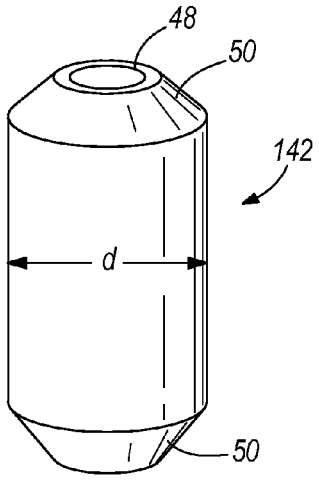
FIG. 3 depicts one example of a solid centralizer.

FIG. 3 illustrates one example of a solid centralizer 142. The solid centralizer 142 has a central bore 48 sized to fit around an outer surface of the tool string 28. Further, the solid centralizer 142 comprises at least one chamfered end 50. As described above, the outer diameter d of the solid centralizer 142 is sized to fit within the inner diameter D of the wellbore 12.

Figure 4:
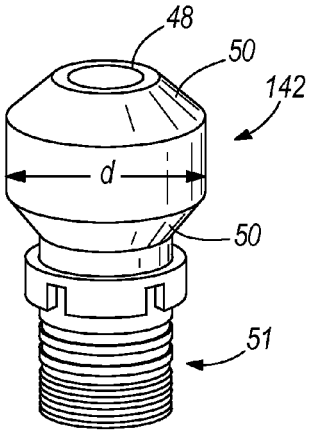
FIG. 4 depicts another example of a solid centralizer.

FIG. 4 illustrates another example of a solid centralizer 142. The solid centralizer 142 comprises a threaded connector portion 51 for connection to an adjacent perforating gun 38 and/or pup joint 46, depending on the location of the solid centralizer 142 on the tool string 28. The solid centralizer of FIG. 4 also comprises at least one chamfered end 50 and a central bore 48, and has an outer diameter d that is sized to fit within the inner diameter D of the wellbore 12.

Figure 5:
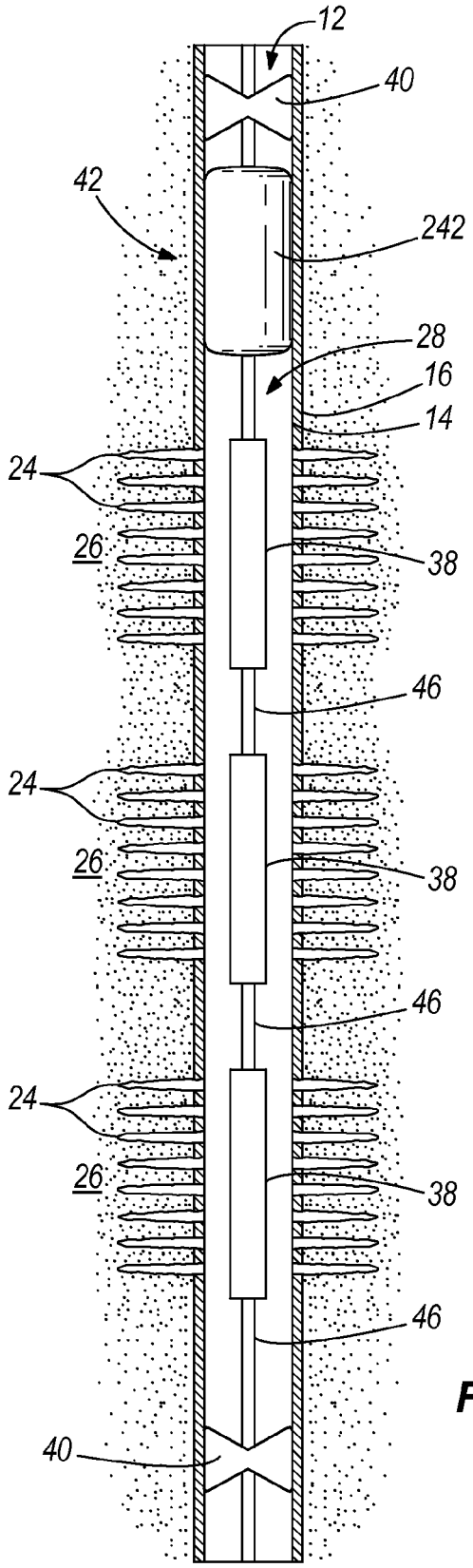
FIG. 5 is a schematic of a tool string and a transient occlusion that comprises a gas pocket.

FIG. 5 illustrates another example of the assembly, comprising one or more perforating guns 38, one or more pup joints 46, and one or more packers 40 disposed on the tool string 28. In this example, the occlusion 42 is a transient occlusion that comprises a gas pocket 242. The gas pocket 242 can be located uphole of the perforating guns 38 and between the upper packer 40 and the perforating guns 38. The gas pocket 242 can be generated by a flammable propellant, a liquefied gas, or a source of compressed air located in the wellbore 12. Where a flammable propellant is used, the flammable propellant can be conveyed to the area in a tube on the tool string 28 and ignited before actuation of the perforating guns 38. Where a liquefied gas is used, it can be conveyed to the area in a tube that is opened to the surrounding wellbore 12 such that the liquefied gas evaporates at the temperature and pressure of the wellbore 12 before actuation of the perforating guns 38.

Figure 6:
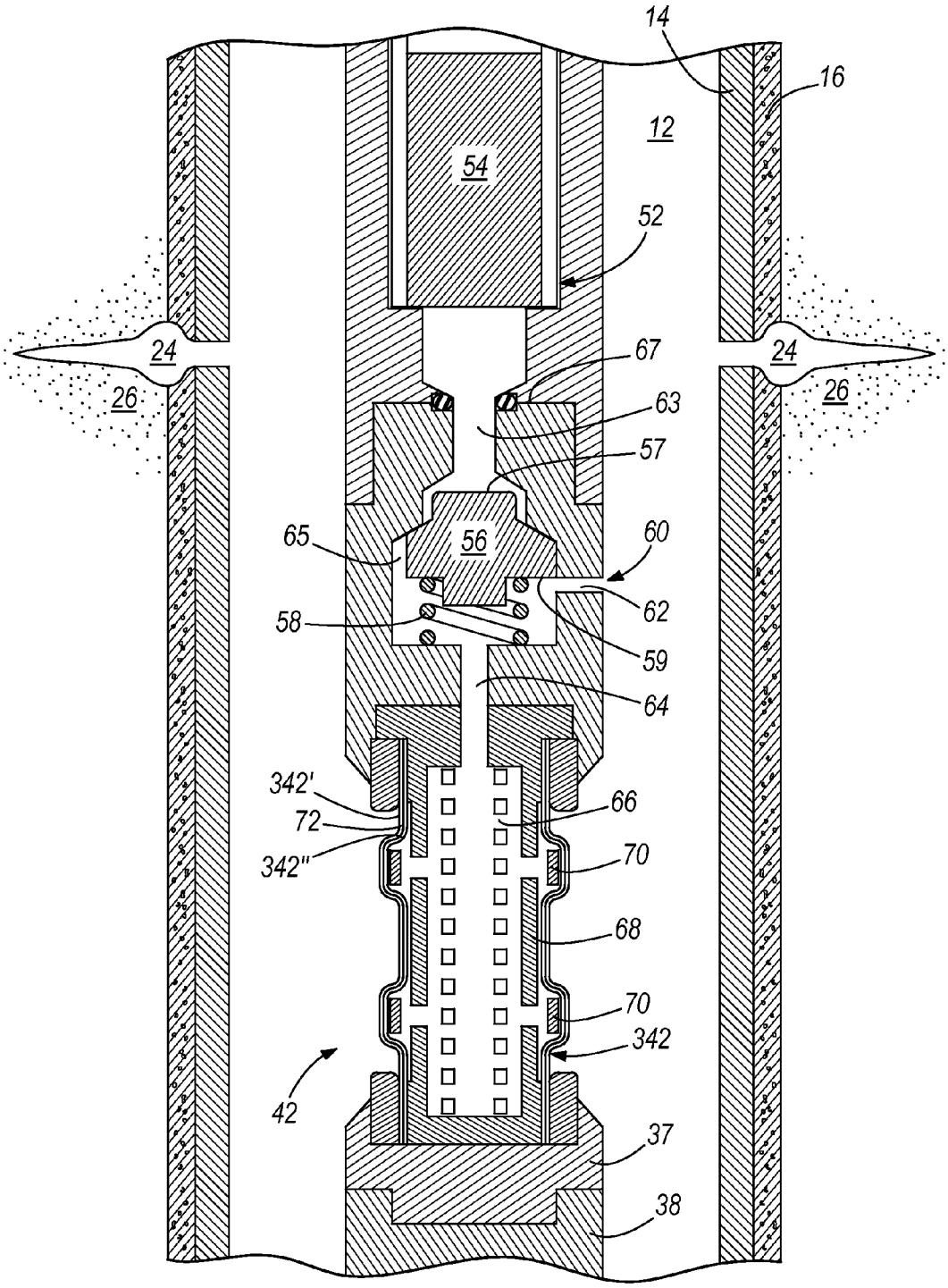
FIG. 6 is a schematic of a tool string and a transient occlusion that comprises a deflated inflatable bladder.

FIG. 6 illustrates another example of the assembly, wherein the occlusion 42 is a transient occlusion that comprises an inflatable bladder 342. In FIG. 6, the inflatable bladder 342 is deflated, while in FIG. 7 it is inflated. Although FIG. 6 shows a close-up of the inflatable bladder 342, other parts of and within the wellbore 12 can be the same as in FIG. 1. For instance, the wellbore 12 can comprise a casing 14 and cement 16 as well as one or more perforation tunnels 24 extending into formation zones 26. Further, the inflatable bladder 342 can be coupled to a perforating gun 38 by a connector 37. One inflatable bladder 342 can be positioned above the perforating gun 38 and another inflatable bladder 342 can be positioned below the perforating gun 38, as is also illustrated in FIG. 1 according to corresponding dynamic device 38 and occlusions 42. When the inflatable bladders 342 are inflated, together they absorb and reflect pressure waves generated by actuation of the perforating gun 38.

In FIG. 6, the inflatable bladder 342 communicates with a burn chamber 52 containing a gas source 54 (such as a flammable propellant, a liquefied gas, or compressed air) via a regulator 60. The regulator 60 has a valve 56 biased into a closed position by a spring 58. The valve 56 has an upper side 57 and a lower side 59 and sits inside a valve chamber 65. The valve chamber 65 communicates with the burn chamber 52 via a port 63 and can be sealed with an O-ring 67. The regulator 60 can also have a hydrostatic port 62 and a throttle port 64. The regulator 60 can be designed to deliver the gas generated in the burn chamber 52 to the inflatable bladder 342 as governed by the wellbore hydrostatic pressure via the hydrostatic port 62. The regulator 60 communicates with the inflatable bladder 342 via a slotted mandrel 66, a buffer mandrel 68, and diverter baffles 70 that direct air flow into the inflatable bladder 342.

The inflatable bladder 342 needs only to expand into and fill the wellbore 12; it does not need to provide a competent seal or to withstand any differential pressure other than that required to inflate it. The inflatable bladder 342 can be designed to burst at any point after filling the wellbore 12 or from the shock of a nearby underbalance or overbalance pressure condition. The inflatable bladder 342 can be made of, for example, platinum-based silicon products and/or the like. In the example shown in FIG. 6, the inflatable bladder 342 comprises a laminated element having first and second inflatable bladders 342' and 342", respectively. A catalyst layer 72 can be disposed between the first and second inflatable bladders 342', 342". Alternatively, only one inflatable bladder 342 can be used and coated on its inside surface with the catalyst layer 72. Where the inflatable bladder 342 is laminated, the catalyst layer 72 disposed between the first and second inflatable bladders 342', 342" can provide lubrication between the inflatable bladders 342', 342", thus promoting smooth inflation. Having two inflatable bladders also creates redundancy should the innermost inflatable bladder 342" be damaged by hot gas impinging on the bladder 342". Having the catalyst layer 72 disposed between the two inflatable bladders 342', 342" can also promote good catalyst coverage over both of the inflatable bladders, promoting faster dissolving of the burst bladders upon contact with wellbore fluids.

In the uninflated state shown in FIG. 6, the inflatable bladder 342 rests closely against the diverter baffles 70 and buffer mandrel 68. The valve 56 is in a closed position because no gas has yet been generated in the burn chamber 52. Thus, there is no gas pressure pushing against the upper side 57 of the valve 56 to counteract hydrostatic pressure from the wellbore 12 acting on the lower side 59 of the valve 56 via the hydrostatic port 62, and the valve 56 remains in the closed position due to bias of the spring 58.

Figure 7:
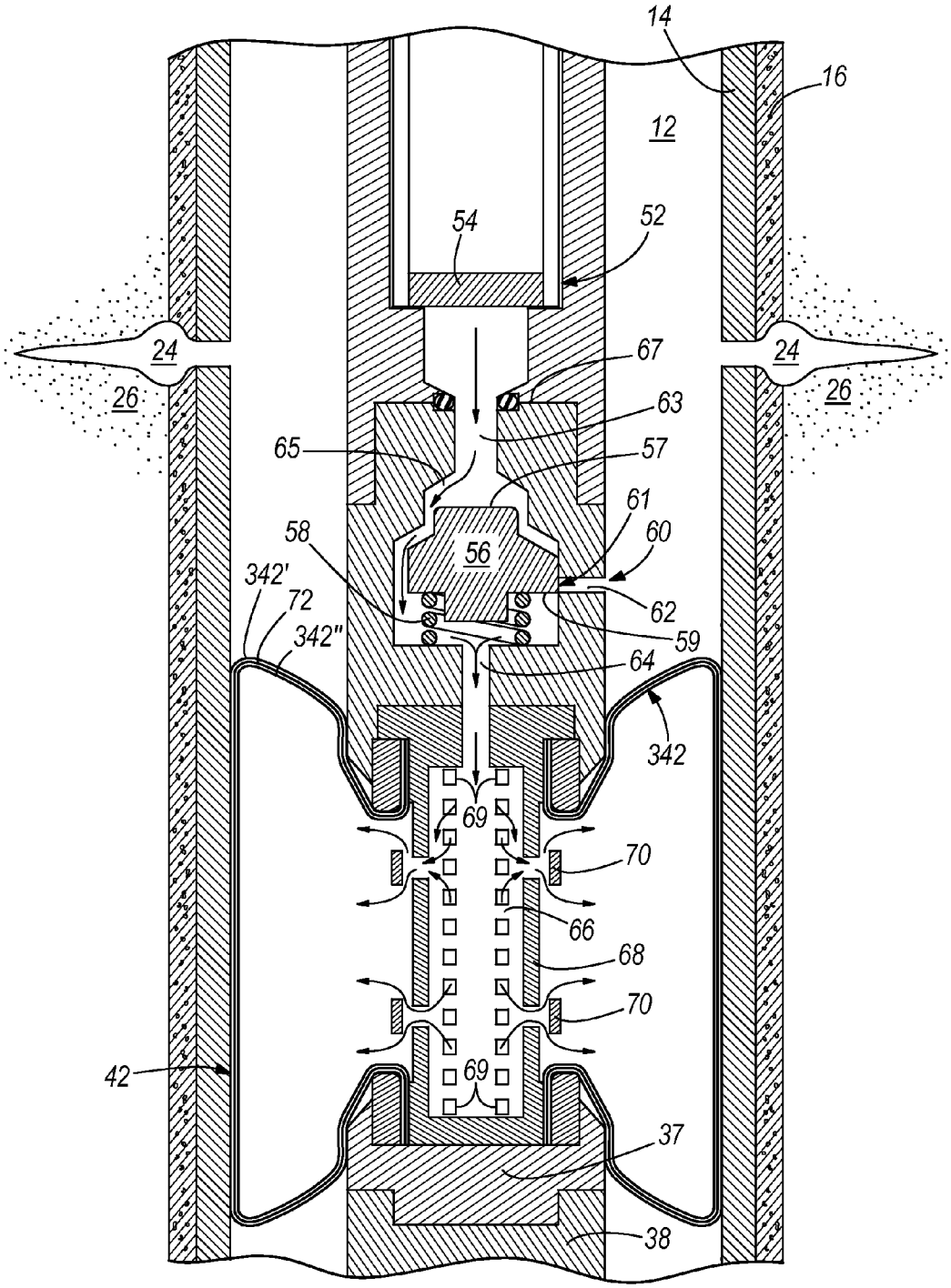
FIG. 7 is a view like FIG. 6, wherein the inflatable bladder is inflated.

FIG. 7 illustrates the assembly of FIG. 6, wherein the inflatable bladder 342 is inflated. Here, the gas source 54 has been partially used, creating gas pressure that acts on the upper side 57 of the valve 56. As pressure from the gas source 54 overcomes the hydrostatic pressure of the wellbore 12, the valve 56 pushes down on the spring 58 and closes off the hydrostatic port 62 as shown at arrow 61, such that hydrostatic pressure from the wellbore 12 no longer acts on the lower side 59 of the valve 56. Gas flows through the port 63 connecting the burn chamber 52 to the valve chamber 65 as shown by the arrows in FIG. 7. Gas does not escape to the surrounding wellbore 12 due to the O-ring 67 between the burn chamber 52 and the regulator 60. Gas flows around the side of the valve 56, but is prevented from escaping into the wellbore 12 by closure of the hydrostatic port 62 at arrow 61. Gas next flows through the throttle port 64 and out through slots 69 in the slotted mandrel 66 as shown by the arrows in FIG. 7. Gas next flows through the buffer mandrel 68 and around diverter baffles 70 such that it does not impinge directly on the inflatable bladder 342. Diversion of the hot gas is shown by arrows in FIG. 7; however, this example is not limiting and other configurations for creating a tortuous path for the hot gas could be used.

After inflation of the inflatable bladder 342, the perforating gun 38 can be triggered for perforation or to create a dynamic underbalance or overbalance condition. Pressure waves created by actuation of the perforating gun 38 will be absorbed and reflected by the inflatable bladders 342, one of which can be positioned on either side of the perforating gun 38 as shown in FIG. 1. The inflatable bladder 342 can be designed to self-destruct, either due to shock from the pressure condition or due to over-inflation until it bursts. The inflatable bladder 342 may burst before or after actuation of the perforating gun 38. Once the inflatable bladder 342 has burst, it will dissolve due to a reaction between the catalyst layer 72 and the wellbore fluid. Thus, where the inflatable bladder 342 is laminated, the catalyst layer 72 is disposed between the two inflatable bladders 342', 342" such that it does not contact wellbore fluid until after the inflatable bladder 342 bursts. Where only one inflatable bladder 342 is used, the catalyst layer 72 is on the inside surface of the inflatable bladder 342 such that the catalyst layer 72 does not contact wellbore fluid until after the inflatable bladder 342 bursts. Dissolving the inflatable bladder 342 can help prevent it from sticking to the tool string 28 or leaving debris in the wellbore 12.

Thus, referring to all the FIGS. 1-7, assemblies for minimizing damaging effects of pressure waves in a wellbore 12 are provided. The assemblies can comprise a dynamic device 138 disposed in the wellbore 12 that generates pressure waves in the wellbore 12; a barrier device 140 disposed in the wellbore 12 that presents an obstacle to the pressure waves generated by the dynamic device 138; and an occlusion 42 disposed in the wellbore 12 between the dynamic device 138 and the barrier device 140 that reduces damaging effects of the pressure waves on the barrier device 140. In one example, the barrier device 140 comprises a packer 40 and the dynamic device 138 comprises a perforating gun 38. In another example, the dynamic device 138 comprises a dynamic overbalance device. In another example, the dynamic device 138 comprises a dynamic underbalance device. In the example of FIG. 2, the packer 40 is disposed on a tool string 28 and the occlusion 42 is a solid occlusion 142 that centers the tool string 28 in the wellbore 12. In the example of FIG. 5, the occlusion 42 is a transient occlusion, and the transient occlusion is a gas pocket 242. The gas pocket 242 is generated by a flammable propellant, a liquefied gas, or a source of compressed air located in the wellbore 12. In the example of FIGS. 6 and 7, the occlusion 42 is a transient occlusion, and the transient occlusion is an inflatable bladder 342. A gas source 54 located in the wellbore 12 inflates the inflatable bladder 342. The gas source 54 is a flammable propellant, a liquefied gas, or a source of compressed air. A valve 56 is movable from a closed position as shown in FIG. 6 to an open position as shown in FIG. 7, to allow gas from the gas source 54 to inflate the inflatable bladder 342. The valve 56 is biased into the closed position shown in FIG. 6 by a spring 58, and actuation of the gas source 54 overcomes the bias of the spring 58 to move the valve 56 into the open position shown in FIG. 7. A throttle mechanism limits inflation rate of the bladder 342. The throttle mechanism has a throttle port 64 and a mandrel, such as a slotted mandrel 66 and/or a buffer mandrel 68 that diverts flow of gas from the gas source 54 to the inflatable bladder 342 to limit impingement of gas on the inflatable bladder 342. The mandrel has a plurality of diverter baffles 70 that also prevent impingement of hot gas directly on the inflatable bladder 342. The inflatable bladder 342 may burst upon over-inflation or due to shock from an underbalance or overbalance pressure condition. Further, the inflatable bladder 342 is coated with a catalyst layer 72 that reacts with wellbore fluid causing the inflatable bladder 342 to dissolve after it bursts. The inflatable bladder 342 can be one of a first 342' and second 342" inflatable bladder and the catalyst layer 72 can be disposed between the first inflatable bladder 342' and the second inflatable bladder 342".

Now with reference to FIGS. 8-10, several methods for minimizing damaging effects of pressure waves in a wellbore 12 will be described.

A method for minimizing damaging effects of pressure waves in a wellbore 12 comprises disposing an occlusion 42 in the wellbore 12 between a dynamic device 138 and a barrier device 140. In the example of FIGS. 8-10, the dynamic device 138 is a perforating gun 38 and the barrier device 140 is a packer 40, but other barrier devices 140, such as for example plugs and/or the like, could be provided. As shown at blocks S110, S210, and S310, the perforating gun 38 is actuated to generate pressure waves and to perforate a casing 14. The occlusion 42 absorbs and reduces damaging effects of the pressure waves on the packer 40, which presents an obstacle to the pressure waves generated by the perforating gun 38. Where the dynamic device 138 is instead a dynamic overbalance device, the method includes actuating the dynamic overbalance device to create an overbalance condition in the wellbore 12, thereby generating the pressure waves. Where the dynamic device 138 is instead a dynamic underbalance device, the method includes actuating the dynamic underbalance device to create an underbalance condition in the wellbore 12, thereby generating the pressure waves.

Figure 8:
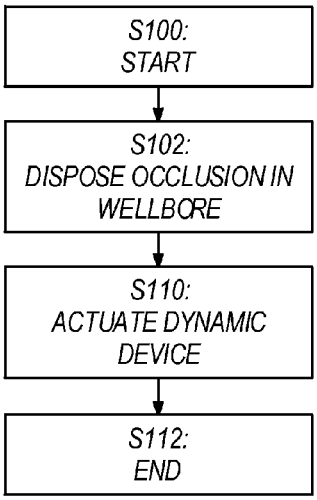
FIG. 8 is a flowchart depicting a method for minimizing damaging effects of pressure waves in a wellbore, wherein a solid occlusion is used.

FIG. 8 illustrates one example of the method for minimizing damaging effects of pressure waves in the wellbore 12 with a solid occlusion, such as a solid centralizer 142. The method begins at block S100. The method comprises disposing the solid centralizer 142 in the wellbore 12 between the perforating gun 38 and the packer 40, as shown at block S102. The method continues with block S110 and the perforating gun 38 is actuated as described above. The method ends at block S112.

Figure 9:
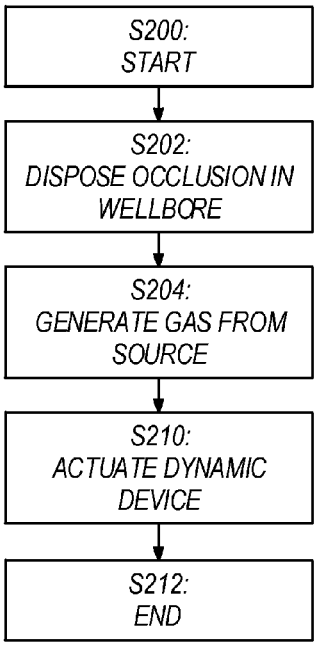
FIG. 9 is a flowchart depicting a method for minimizing damaging effects of pressure waves in a wellbore, wherein a gas pocket is used.

FIG. 9 illustrates another example of the method for minimizing damaging effects of pressure waves in the wellbore 12 with a transient occlusion such as a gas pocket 242. The method begins at block S200. A gas source 54 is disposed in the wellbore 12 at block S202. Gas is generated from the gas source 54 at block S204 by igniting a flammable propellant, evaporating a liquefied gas, or actuating a source of compressed air to generate the gas pocket 242. Once the gas pocket 242 is generated by the gas source 54, the method continues to block S210 and the perforating gun 38 is actuated as described above. The method ends at block S212.

Figure 10:
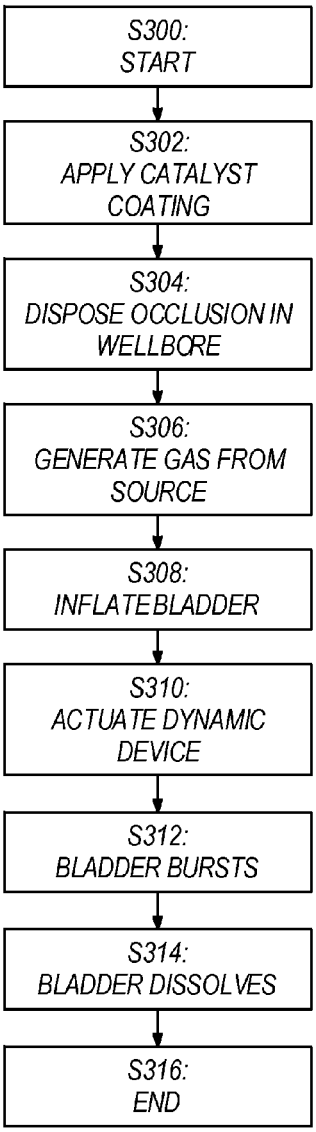
FIG. 10 is a flowchart depicting a method for minimizing damaging effects of pressure waves in a wellbore, wherein an inflatable bladder is used.

FIG. 10 illustrates another example of a method for minimizing damaging effects of pressure waves in the wellbore 12 with a transient occlusion, such as an inflatable bladder 342. The method begins at block S300. The method comprises applying a catalyst, such as a catalyst layer 72, on the inflatable bladder 342 at block S302. At block S304, the inflatable bladder 342 is disposed in the wellbore 12. The method continues at block S306, and gas is generated from a gas source 54, as a flammable propellant is ignited, a liquefied gas is evaporated, or a source of compressed air is actuated to inflate the inflatable bladder 342, as shown at block S308. The method continues to block S310 and the perforating gun 38 is actuated as described above. After actuating the perforating gun 38, the inflatable bladder 342 continues to inflate until the inflatable bladder 342 bursts, as shown at block S312. The inflatable bladder 342 may also burst due to over-inflation before actuation of the perforating gun 38, in which case the gas left in the wellbore 12 may provide the same results of absorbing and reflecting pressure waves generated by actuation of the perforating gun 38. The catalyst layer 72 on the inflatable bladder 342 reacts with a wellbore fluid to dissolve the inflatable bladder 342 after the inflatable bladder 342 bursts, as shown at block S314. The method ends at block S316.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words "means for" together with an associated function.

What is claimed is:

1. An assembly for minimizing damaging effects of pressure waves in a wellbore, the assembly comprising:

a dynamic device disposed in the wellbore and generating pressure waves in the wellbore, wherein the dynamic device comprises a dynamic overbalance device or a dynamic underbalance device;

a barrier device disposed in the wellbore and presenting an obstacle to the pressure waves generated by the dynamic device; and an occlusion disposed in the wellbore between the dynamic device and the barrier device and reducing damaging effects of the pressure waves on the barrier device.

2. An assembly according to claim 1, wherein the barrier device comprises a packer.

3. An assembly according to claim 1, wherein the barrier device is disposed on a tool string and wherein the occlusion comprises a solid occlusion that centers the tool string in the wellbore.

4. An assembly according to claim 3, wherein the wellbore has an inner diameter, and wherein the solid occlusion has an outer diameter that is smaller than the inner diameter of the wellbore, and wherein the outer diameter of the solid occlusion is close to the inner diameter of the wellbore so as to center the tool string in the wellbore.

5. An assembly according to claim 4, wherein the solid occlusion comprises at least one chamfered end.

6. An assembly according to claim 1, wherein the occlusion is located uphole of the dynamic device.

7. An assembly according to claim 6, comprising another occlusion located downhole of the dynamic device, wherein the occlusions together absorb and reflect the pressure waves generated by the dynamic device.

8. An assembly according to claim 7, comprising a first plurality of occlusions located uphole of the dynamic device and a second plurality of occlusions located downhole of the dynamic device, wherein the first plurality of occlusions is equal in number to the second plurality of occlusions.

9. An assembly for minimizing damaging effects of pressure waves in a wellbore, the assembly comprising:

a dynamic device disposed in the wellbore and generating pressure waves in the wellbore;

a barrier device disposed in the wellbore and presenting an obstacle to the pressure waves generated by the dynamic device; and an occlusion disposed in the wellbore between the dynamic device and the barrier device and reducing damaging effects of the pressure waves on the barrier device; wherein the occlusion comprises a transient occlusion comprising a gas pocket or an inflatable bladder.

10. An assembly according to claim 9, wherein the dynamic device comprises a perforating gun.

11. An assembly according to claim 9, wherein the transient occlusion further comprises at least one of a flammable propellant, a liquefied gas, and a source of compressed air located in the wellbore and generating the gas pocket.

12. An assembly according to claim 9, wherein the transient occlusion further comprises a gas source located in the wellbore and inflating the bladder.

13. An assembly according to claim 12, wherein the gas source comprises at least one of a flammable propellant, a liquefied gas, and a source of compressed air.

14. An assembly according to claim 9, comprising a valve that is movable from a closed position to an open position to allow gas from the gas source to inflate the bladder.

15. An assembly according to claim 14, wherein the valve is biased into the closed position by a spring and wherein actuation of the gas source overcomes the bias of the spring to move the valve into the open position.

16. An assembly according to claim 9, comprising a throttle mechanism limiting inflation rate of the bladder.

17. An assembly according to claim 16, wherein the throttle mechanism comprises a mandrel that diverts flow of gas from the gas source to the inflatable bladder to limit impingement of gas on the bladder.

18. An assembly according to claim 17, wherein the mandrel comprises a plurality of diverter baffles.

19. An assembly according to claim 9, wherein the inflatable bladder bursts upon over-inflation.

20. An assembly according to claim 9, wherein the inflatable bladder is coated with a catalyst that reacts with wellbore fluid causing the bladder to dissolve.

21. An assembly according to claim 20, wherein the bladder is one of first and second bladders and wherein the catalyst is disposed between the first bladder and the second bladder.

22. A method for minimizing damaging effects of pressure waves in a wellbore, the method comprising:

disposing an occlusion in the wellbore between a dynamic device and a barrier device, the barrier device presenting an obstacle to the pressure waves generated by the dynamic device, wherein the dynamic device comprises a dynamic overbalance device or a dynamic underbalance device; and actuating the dynamic device and thereby generating pressure waves, wherein the occlusion absorbs and reduces damaging effects of the pressure waves on the barrier device.

23. A method according to claim 22, further comprising actuating a perforating gun to perforate a casing in the wellbore, thereby generating the pressure waves.

24. A method according to claim 22, further comprising actuating the dynamic overbalance device to create an overbalance condition in the wellbore, thereby generating the pressure waves.

25. A method according to claim 22, further comprising actuating the dynamic underbalance device to create an underbalance condition in the wellbore, thereby generating the pressure waves.

26. A method according to claim 22, wherein the occlusion comprises a solid occlusion.

27. A method according to claim 22, wherein the occlusion comprises a gas pocket.

28. A method according to claim 27, comprising igniting a flammable propellant to generate the gas pocket.

29. A method according to claim 27, comprising evaporating a liquefied gas to generate the gas pocket.

30. A method according to claim 27, comprising actuating a source of compressed air to generate the gas pocket.

31. A method according to claim 22, wherein the occlusion comprises an inflatable bladder, the method further comprising inflating the bladder.

32. A method according to claim 31, comprising continuing to inflate the inflatable bladder until the bladder bursts.

33. A method according to claim 32, comprising applying a catalyst on the inflatable bladder that reacts with a wellbore fluid to dissolve the bladder after the bladder bursts.

34. A method according to claim 31, comprising at least one of igniting a flammable propellant to inflate the bladder, evaporating a liquefied gas to inflate the bladder, and actuating a source of compressed air to inflate the bladder.

* * * * *